United States Patent [19]

Sillner

[11] Patent Number: 4,738,198

[45] Date of Patent: Apr. 19, 1988

[54] PRINTING MECHANISM

[76] Inventor: Georg Sillner, Buchenstrasse 23, 8411 Zeitlarn, Fed. Rep. of Germany

[21] Appl. No.: 841,095

[22] Filed: Mar. 18, 1986

[30] Foreign Application Priority Data

Mar. 19, 1985 [DE] Fed. Rep. of Germany ... 8508103[U]
Nov. 21, 1985 [DE] Fed. Rep. of Germany ... 8532754[U]

[51] Int. Cl.[4] ..... B41F 17/00
[52] U.S. Cl. ..... 101/44; 101/163
[58] Field of Search ..... 101/44, 41, 35, 163, 101/150, 151

[56] References Cited

U.S. PATENT DOCUMENTS

| | | | |
|---|---|---|---|
| 3,742,843 | 7/1973 | Gulikers | 101/41 |
| 3,916,784 | 11/1975 | Dubuit | 101/41 |
| 4,060,031 | 11/1977 | Philipp | 101/41 X |
| 4,557,195 | 12/1985 | Phlipp | 101/163 |

FOREIGN PATENT DOCUMENTS

| | | | |
|---|---|---|---|
| 140384 | 5/1985 | European Pat. Off. | 101/150 |
| 56-866 | 5/1981 | Japan | 101/41 |
| 210877 | 4/1968 | U.S.S.R. | 101/35 |

OTHER PUBLICATIONS

Pitts, "Rotary Indexed Printing Plate", IBM Technical Disclosure Bulletin, vol. 20, No. 9, Feb. 1978, pp. 3620–3621.

*Primary Examiner*—Clifford D. Crowder
*Attorney, Agent, or Firm*—Charles W. Fallow; Martin P. Hoffman; Mitchell B. Wasson

[57] ABSTRACT

In a printing mechanism for producing an impression on a surface of material to be printed lying in a printing plane, a first element is provided which is mounted on the machine frame so as to be rotatable about a first axis of rotation and is driven in a clock-timed manner and which comprises at least one print transfer surface on at least one surface area. In addition, a second element is provided which is mounted on the machine frame so as to be rotatable about a second axis of rotation extending parallel to the first and is likewise driven in a clock-timed manner and which comprises at least one printing plate constantly provided with printing ink on at least one surface area facing the first element. The two elements are movable relative to one other between an operative position, in which the print transfer surface bears against a printing plate, and a rest position, in which the print transfer surface is at a distance from the printing plate. The (at least one) printing plate and the (at least one) print transfer surface are disposed in planes extending at right angles to the axes of rotation. The elements are movable relative to one another in the direction of the axes of rotation.

17 Claims, 11 Drawing Sheets

PRINTING MECHANISM

Printing mechanisms for printing the surfaces of material to be printed are known per se and are used for example in the manufacture of electrical components in order to print type designations etc. on these components.

The object of the invention is to disclose a printing mechanism which will permit trouble-free printing of material to be printed with a relative simple design and with a high degree of efficiency.

The printing mechanism according to the invention is characterized by a simple and reliably operating design and provides in a trouble-free manner printed images which are not transferred directly from the printing plates to the surfaces of the material to be printed but are transferred in an indirect printing process by using the print transfer surfaces.

In a preferred embodiment of the printing mechanism according to the invention the second element is provided with a circular or annular recess, on the base of which is provided the printing plate, of which there is at least one. This permits a cleaner operation of the printing mechanism even with a relatively large amount of excess printing ink, which [excess amount] ensures a trouble-free inking of the (at least one) printing plate, excess printing ink being transferred by a wiper or a removal device from the area provided with the (at least one) printing plate into an area at the outer or inner edge of the recess after the printing plate has been inked. This excess printing ink transferred in or out is then used or jointly used again for inking the printing plate.

According to a further embodiment, the first element comprises two individual elements which are arranged offset with respect to one another in the direction of the first axis of rotation, at least one print transfer surface being provided on the mutually facing sides of the two individual elements of the first element in each case, and the (at least two) mutually facing print transfer surfaces being movable in opposite directions in the direction of the first axis of rotation from the rest position, in which the mutually facing print transfer surfaces are at a greater distance from one another, into the operative position, in which the mutually facing print transfer surfaces are closer to one another, the second element comprising at least one printing plate in each case on two surface areas facing away from one another.

This embodiment has the advantage that with a relatively simple design and high degree of efficiency a trouble-free, simultaneous printing of material to be printed on two surface sides facing away from one another is possible. The two individual elements of the first element are preferably constructed in the form of circular discs and comprise the (at least two) print transfer surfaces on the end faces which face one another. In this connexion the second element is likewise preferably constructed in the form of a circular disc and comprises at least one printing plate in each case at both end faces. A plurality of print transfer surfaces are preferred on each individual element, however, and a plurality of printing plates on the two surface areas of the second element.

Further developments of the invention form the subject of the sub-claims.

The invention is described in greater detail below in conjunction with the drawings with reference to an embodiment. In the drawings FIG. 1 is a side view of the embodiment of the printing mechanism according to the invention [shown] partly in longitudinal section;

Figure 1:
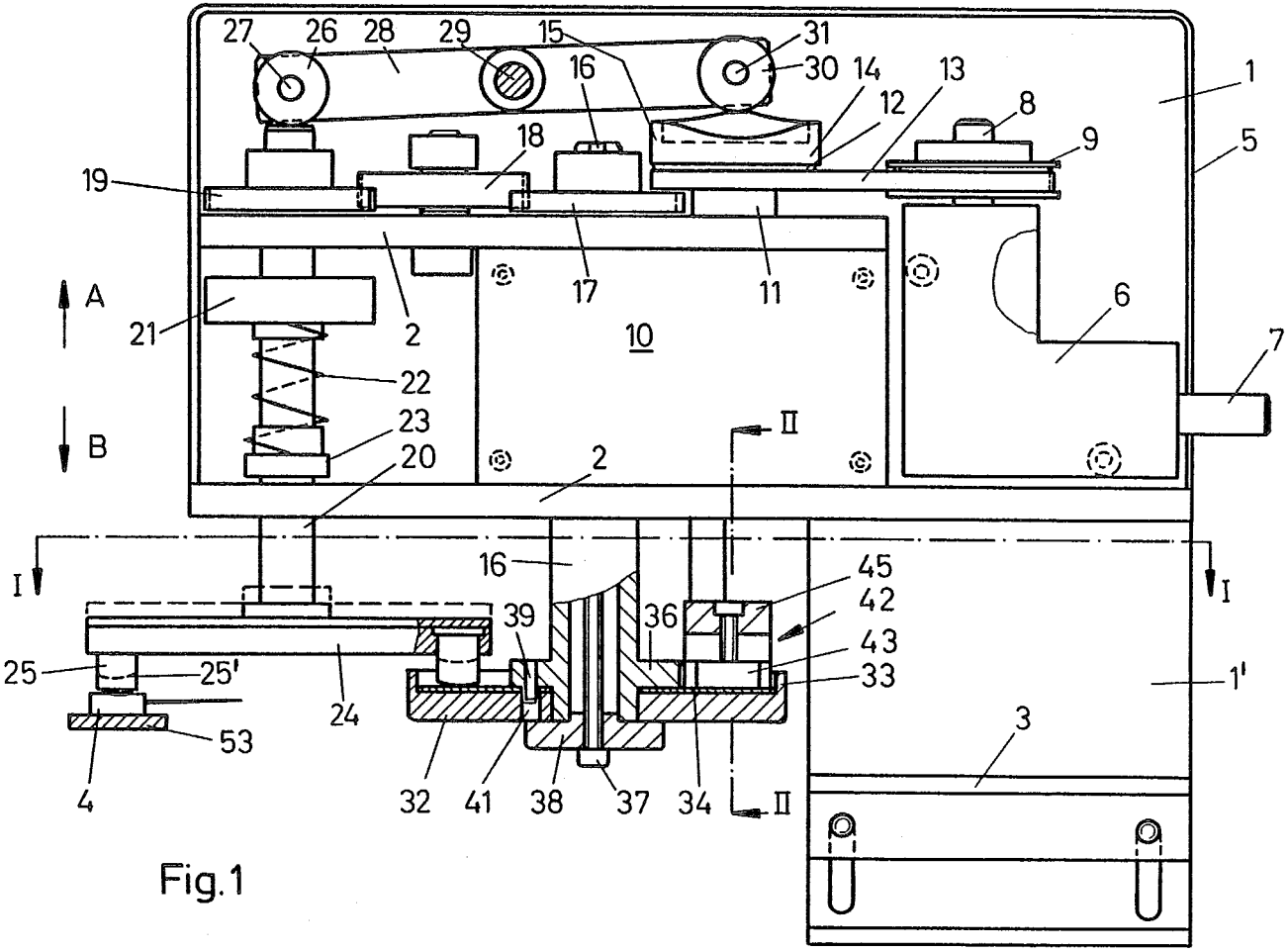

The printing mechanism according to FIGS. 1 to 4 comprises a machine frame or machine support which is formed by two plate slabs 1 which are disposed with their surface sides in vertical planes and are arranged parallel and at a distance from one another and which are connected to one another by way of two plate slabs disposed with their surface sides in horizontal planes are arranged at a distance one above the other. On their lateral edge at the bottom in FIG. 1 the two plate slabs 1 formed essentially rectangularly comprise in each case in the region of the right-hand end an extension 1' projecting below from this lateral edge. On these extensions the plate slabs 1 and thus the printing mechanism can be secured by way of angled members 3 to a work bench or to an assembly line where the material to be printed 4, which is formed by electrical components in the embodiment illustrated, is to be provided with an impression. In the illustration selected for FIG. 1, the space formed between the two plate slabs 1 is closed at the top and at the left-hand and right-hand sides by a hook-like casing part 5, which also covers the exterior sides of the plate slabs 1.

Between the two plate slabs 1 is secured a driving element 6 which in the embodiment illustrated is formed by an angular gear, the driven shaft 7 of which, extended through the casing part 5 to the outside, can be connected either directly or by way of further coupling elements to a driving motor (electric motor), and the driving shaft 8 of which supports a toothed belt pulley 9. The driving element 6 can also of course be a driving motor (electric motor), on the shaft of which the toothed belt pulley 9 is then secured.

Between the plate slabs 1 is further provided a step-by-step motion linkage 10, the driven shaft 11 of which, lying parallel to the shaft 8 and extending in a vertical direction, is likewise provided with a toothed belt pulley 12 which is connected in a driving manner to the toothed belt pulley 9 by way of a toothed belt 13. At the upper end of the shaft 11 continuously driven by the driving element 6 a control disc 14 is mounted above the tooth belt pulley 12. On its upper end face remote from the step-by-step motion linkage 10 the control disc 14 is provided on its periphery with a continuous annular edge 15 which projects beyond the said end face and extends concentrically to the axis of the shaft 11 and the height of which, in order to form a control cam about the periphery of the control disc 14, changes in such a way that the edge 15 has a region of maximum height and a region of minimum height, which are offset with respect to one another by 180° about the axis of the shaft 11 and pass into one another in such a way that the edge 15 in the angle has a height which varies as a function of a sine curve.

The step-by-step motion linkage 10 further comprises a driving shaft 16, the axis of which likewise lies in a vertical direction and which projects beyond the top side and beyond the underside of the step-by-step motion linkage 10. A gearwheel 17, which is connected in a driving manner to a gearwheel 19 by way of an intermediate gearwheel 18 rotatably mounted on the upper plate slab 2, is secured to the end of the shaft 16 projecting beyond the top side of the step-by-step motion linkage. The gearwheel 19 is mounted on a shaft 20 which likewise extends with its axis in a vertical direction and which is mounted in the upper and lower plate slabs 2 so as to be rotatable and at the same time axially displaceable.

In the region between the two plate slabs 2 the shaft 20 is provided with a collar or with a portion 21 of increased cross-section, against which bears the upper end of a compression spring 22 which surrounds the shaft 20 and which is supported at its lower end against a sleeve 23, which is mounted on the shaft 20 so as to be displaceable in the longitudinal direction of the said shaft and which in turn bears with its underside remote from the portion 21 against the top side of the lower plate slab 2 or against a bearing element provided there. By means of the compression spring 22 the shaft 20 is pretensioned upwards for an axial movement, i.e. in the direction of the arrow A in FIG. 1.

On the lower end of the shaft 20 projecting beyond the underside of the lower plate slab 2 is secured an element 24 in the shape of a plate or circular disc, which, in the embodiment illustrated, comprises in the region of its peripheral surface four elements 25 formed essentially cylindrically from resilient material, for example of rubber or elastic plastics material. The elements 25, which are each at an equal radial distance from the axis of the shaft 20 and lie with their cylinder axis parallel to the axis of the shaft 20, are each offset with respect to one another by 90° about the axis of the shaft 20 and each project by the same length beyond the lower end face of the element 24, i.e. the end face remote from the lower plate slab 2, and form the print transfer surfaces on their lower convex surface 25'.

A roller 26, which is mounted at one end of a trouble-armed lever 28 so as to be rotatable with the aid of a bearing journal 27 about an axis extending at right angles to the plate slabs 1, bears against the upper end of the shaft 20 projecting beyond the upper plate slab 2. The lever 28, which is rotatably secured in its central area to the plate slabs 1 with the aid of a pivot pin 29 whose axis likewise extends at right angles to the surface sides of the said plate slabs, is provided at its other end with a further roller 30, which is mounted there so as to be rotatable with the aid of a shaft 31 likewise about a spatial axis extending at right angles to the surface sides of the plate slabs 1 and bears against the top side of the edge 15 forming the control cam. As the shaft 11 rotates, the shaft 20 is reciprocated in the axial direction by way of the control cam formed by the edge 15 and the lever 28 (in cooperation with the compression spring 22), namely once upwards (arrow A) and then once downwards (arrow B) on each complete revolution of the shaft 11.

At the end of the shaft 16 projecting beyond the underside of the step-by-step motion linkage 10 and beyond the lower plate slab 2 is secured a second element 32 in the form of a circular disc, which is provided on the periphery at its end face which faces the lower plate slab 2 with a continuous edge 33 which projects beyond the end face which faces the lower plate slab 2. The element 32 is made bowl- or plate-shaped by this edge 33. Inside the region surrounded by the edge 33 a disc 34 provided with a central opening bears against the end face of the element 32 at that position. In the embodiment illustrated, the said disc 34 is provided at least on its surface side facing the lower plate slab 2 with a plurality of different printing plates **35*a*, 35*b* and 35*c* (FIG. 4) which are formed in each case by linear or punctiform recesses in the said surface side. Corresponding to the number of elements 25 on the element 24 the different printing plates 35*a*, 35*b* and 35*c* are also provided in quadruplicate in each case, in such a way that the respectively similar printing plates are offset with respect to one another by 90° about the axis of the shaft 16, i.e., in the case of the embodiments illustrated, the printing plates 35*a*, 35*b* and 35*c* are arranged in each case in four groups about the axis of the shaft 16, such that in each group one printing plate 35*a* is followed by a printing plate 35*b* and the latter is followed by a printing plate 35*c*, in each case offset with respect to one another by 30°. It is also possible, of course, to provide more than three or less than three printing plates in each group. In addition, it is also possible, in accordance with the number of elements 25 on the element 24, to use more or less than four groups of printing plates. The element 32 and the flat disc 34 provided with the printing plates are clamped firmly between a collar 36 and a clamping plate 38 held on the lower end of the shaft 16 with the aid of a bolt 37. A pin 39, which extends through an adjustment aperture 40*a*, 40*b* and 40*c* respectively provided in the plate 34 into a bore 41 in the element 32, projects beyond the lower end face of the collar 36 remote from the lower plate slab 2. The number of the adjustment bores 40*a* to 40*c* corresponds to the number of the different printing plates 35*a* to 35*c*, the adjustment bores being offset with respect to one another at the same angular distances from one another about the axis of the shaft 16, at which [angular distance] the different printing plates 35*a* to 35*c* in one group are distant from one another. It is therefore possible, by introducing the centring pin 39 into a centring bore 40*a* to 40*c*, to select for the printing procedure only those printing plates which are associated with the said centring bore and similar in each case, so that it is also possible, in accordance with the selection made in each case, to provide the material to be printed 4 with a different impression while using one and the same disc 34**.

Between the circular cylindrical peripheral surface of the collar 36 and the inner surface of the edge 33 is formed an annular recess which is open at the top and on the base area of which are disposed the printing plates 35*a* to 35*c*. As shown in FIG. 1, the two elements 24 and 32 are additionally arranged relative to one another in such a way that the said elements overlap one another with a partial area, the element 24 being disposed above the element 32 in such a way that the elements 24 and 32 overlap one another in a partial area in the vertical direction, and in this partial area the path of movement, on which the elements 25 revolve as the shaft 20 rotates, lies directly above the path of movement on which the printing plates 35*a* to 35*c* disposed in each case at the same radial distance from the axis of the shaft 16 revolve as the shaft 16 rotates.

Figure 2:
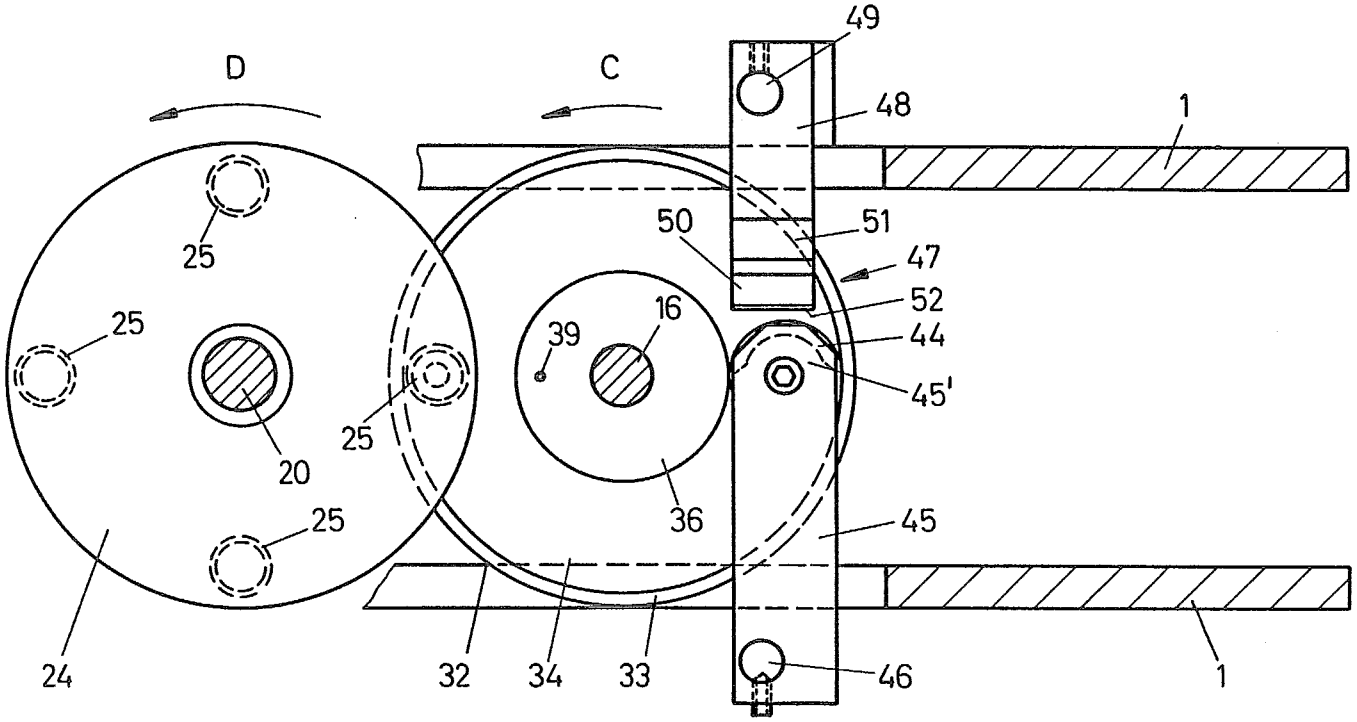
FIG. 2 is a section corresponding to the line I—I of FIG. 1.
Figure 3:
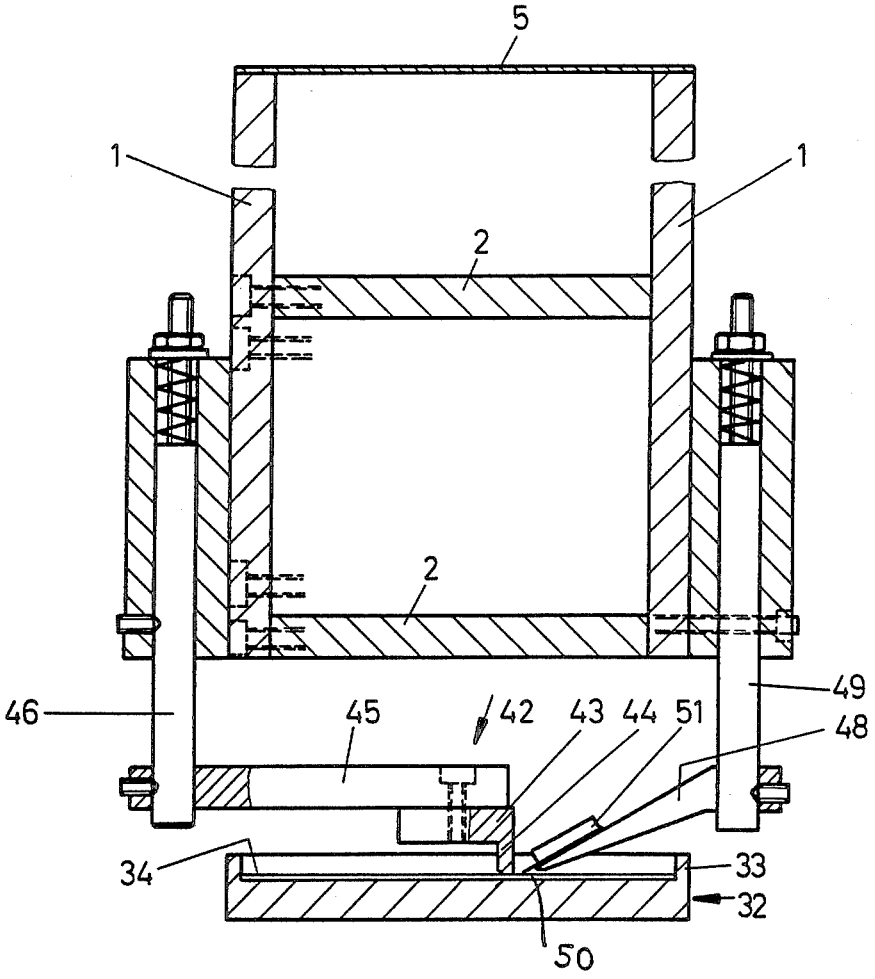
FIG. 3 is a section, shown somewhat simplified, corresponding to the line II—II of FIG. 1.
Figure 4:
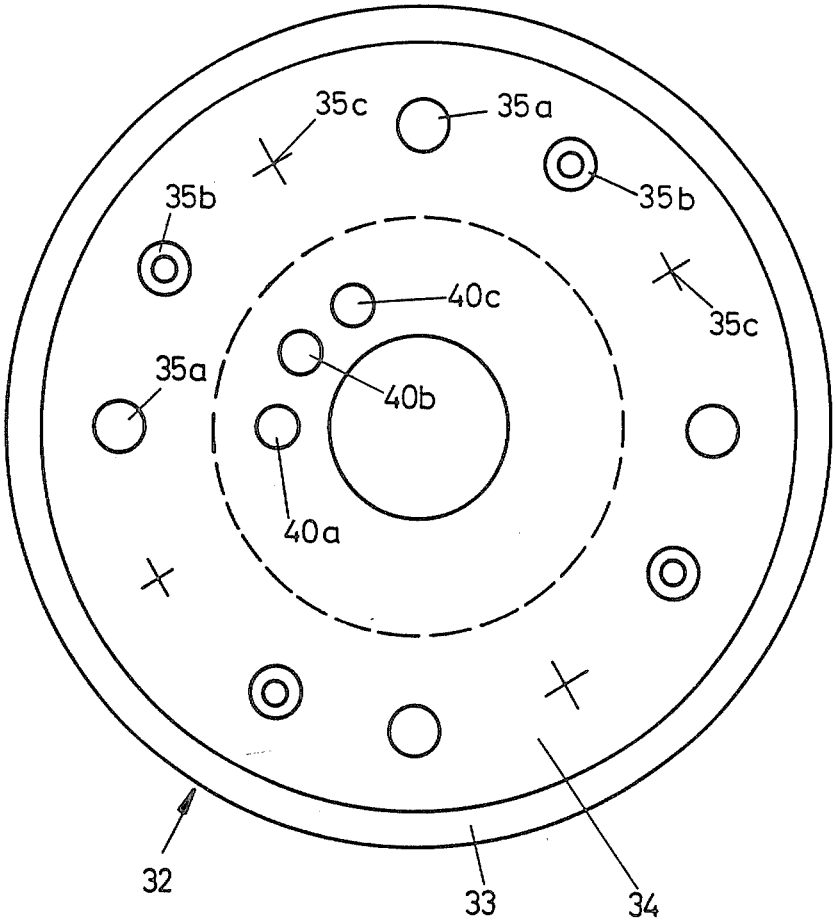
FIG. 4 is a detailed plan view of the side—provided with the printing plates—of the second element comprising the said printing plates.

A device 42 for applying printing ink is provided on the side of the shaft 16 remote from the element 24. This device 42 is formed essentially by a doctor blade or a wiper 43 which extends from above into the annular space between the collar 36 and the edge 33 and bears with its lower edge against the surface side of the disc 34 provided with the printing plates 35*a* to 35*c* and facing the lower plate slab 2. As shown in FIG. 2, the portion of the wiper 43 extending into the annular space is formed by a curved wall 44 which extends with its surface sides essentially in a vertical direction and which is arranged in such a way that in the direction of rotation of the element 32 as indicated by the arrow C in FIG. 2 the concave side of the wall 44 forms the front side of the wiper 43 as viewed in the direction of rotation, i.e. there is formed on this side of the wiper 43 a space 45' which is partly surrounded by the wall 44 and in which printing ink is applied to the top side of the disc 34 by way of a nozzle opening (not shown in greater detail) and in which there is preferably a certain constant excess of printing ink. This printing ink is then distributed by the lower wiping edge of the wiper 43 or the wall 44 in such a way that after the disc 34 has moved past the wiper 43 the printing ink is present at least on the annular surface area, on which are arranged the printing plates 35*a* to 35*c*, mainly only in the punctiform or linear recesses forming the said printing plates. The wiper 43 is held at one end of a horizontal holding arm 45, which is secured at its other end to one of the two plate slabs 1 by way of a holding bar 46. Following the wiper 43 in the direction of rotation of the element 32 (arrow C) is provided a removal device 47 which is secured to the other plate slab 1 by means of a holding arm 48 extending obliquely upward and a holding bar 49. In the embodiment illustrated, the removal device 47 comprises a cutter blade 50, which in the simplest case is formed by a razor blade and which is arranged with its surface sides oblique to the top side of the disc 34 in such a way that the cutter blade 45 together with the top side of the disc 34 forms an acute angle which opens in the direction of rotation (arrow C) of the element 32. The cutter blade 50, which is held by means of a holding block 51 and bolts (not shown in greater detail) on the holding arm 48 by clamping, bears with its front cutting edge 52 as viewed in the direction of rotation (arrow C) of the element 32 against the area of the top side of the disc 34 provided with the printing plates 35*a* to 35*c*. On account of the cutter blade 50 or its cutting edge 52 excess printing ink which is possibly present is removed or scraped off from the area of the top side of the disc 34 provided with the printing plates. Since the effective length of the cutting edge 52 is less than the width of the annular space between the collar 36 and the edge 33 and so the cutting edge 52 in particular is also at a distance from the cyindrical peripheral surface of the collar 36 and in addition is also arranged obliquely to the direction of rotation (arrow C) of the element 32 in such a way that the end of the cutting edge 52 lying adjacent to the collar 36 lies on a line which extends radially to the axis of the shaft 16 and which in the direction of rotation (arrow C) of the element 32 precedes the corresponding line for the end of the cutting edge 52 adjacent the edge 33, excess printing ink removed from the cutting edge 52 is brought radially inwards from the surface region comprising the printing plates and after passing the removal device 47 forms a bead-like store of printing ink which surrounds the collar 36 and which is then uniformly distributed again by the wiper 43 (if necessary with fresh printing ink) and is jointly used for inking in the printing plates 35*a* to 35*c*. It is to be understood that for this operation the wall 44 is to extend as closely as possible to the collar 36.

The mode of operation of the printing mechanism may be described as follows:

The material to be printed 4 or the individual components respectively are supplied in a clock-timed manner to the printing mechanism by way of a conveying device 53, which is driven synchronously with the drive of the printing mechanism.

Since the gearwheels 17 and 19 have the number of teeth and are connected together in a driving manner by way of the gearwheel 18, both elements 24 and 32 are rotated in the same direction and at the same speed, as indicated by the arrows C and D.

The step-by-step motion linkage 10 is designated in such a way that during a complete revolution of the shaft 11 the elements 24 and 32 execute a movement step of 90° with the preceding or following stoppage phase, in such a way that when the shaft 20 is lowered from its upper position by a certain amount in the direction of arrow B, the two elements 24 and 32 are always stationary and one printing plate 35*a* or 35*c* respectively is always directly opposite one element 25 and one surface of the material to be printed 4 is always directly opposite another element 25. As the shaft 11 rotates further and as the shaft 20 sinks further (with the elements 24 and 32 stationary), one element 25 comes to rest with its underside for receiving a printed image on a printing plate and the other element 25 comes to rest with its underside for transferring the printed image onto the material to be printed 4 on the surface of the said material to be printed. The shaft 20 then moves upwards in the direction of arrow A. From a specific position, i.e. for example when the underside of the elements 25 is at a higher lever than the upper face of the edge 33, the elements 24 and 32 are each rotated further by a shifting step (angular step of 90°). The shaft 20 is then lowered again, so that one printed image is in turn received by one element 25 and a printed image can be transferred from one element 25 to a new article for printing 4 which has not yet been printed.

Figure 5:
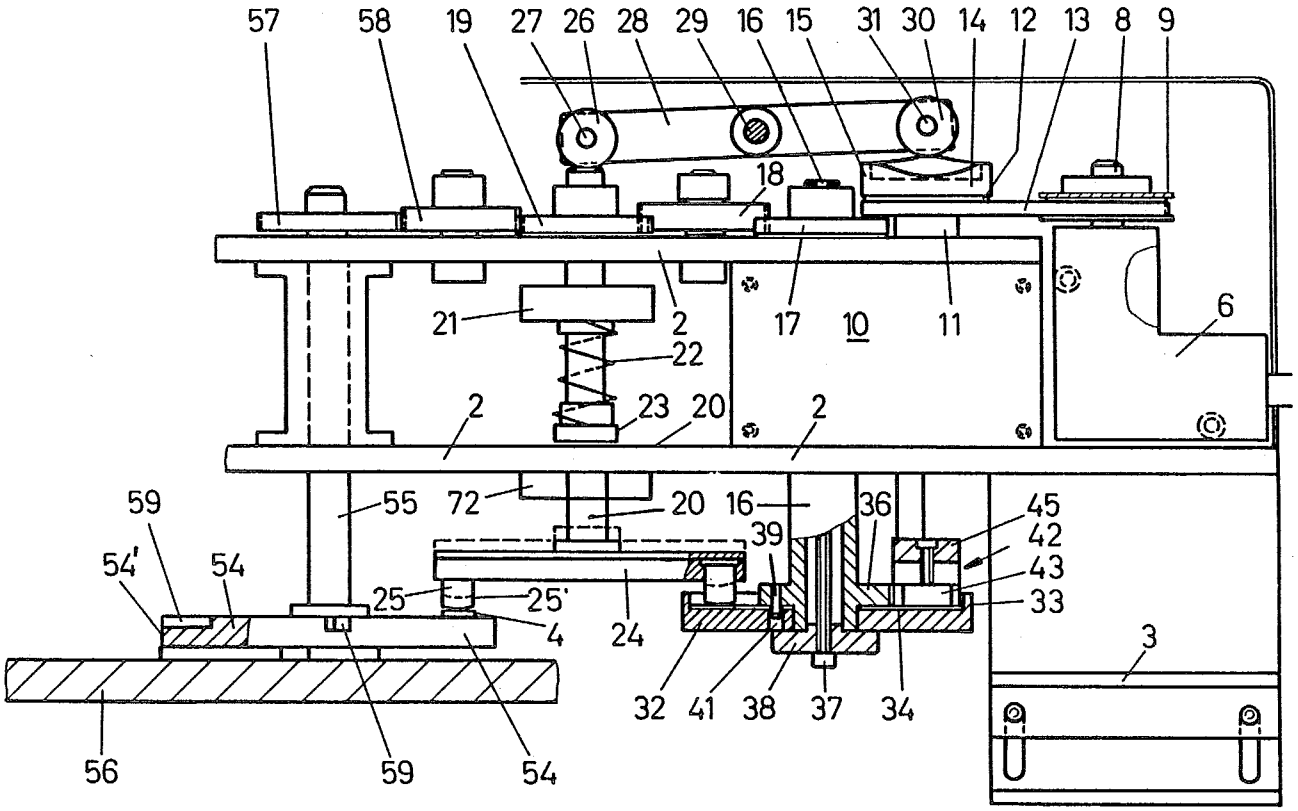
FIG. 5 shows in a similar view to FIG. 1 a modified embodiment of the printing mechanism.
Figure 6:
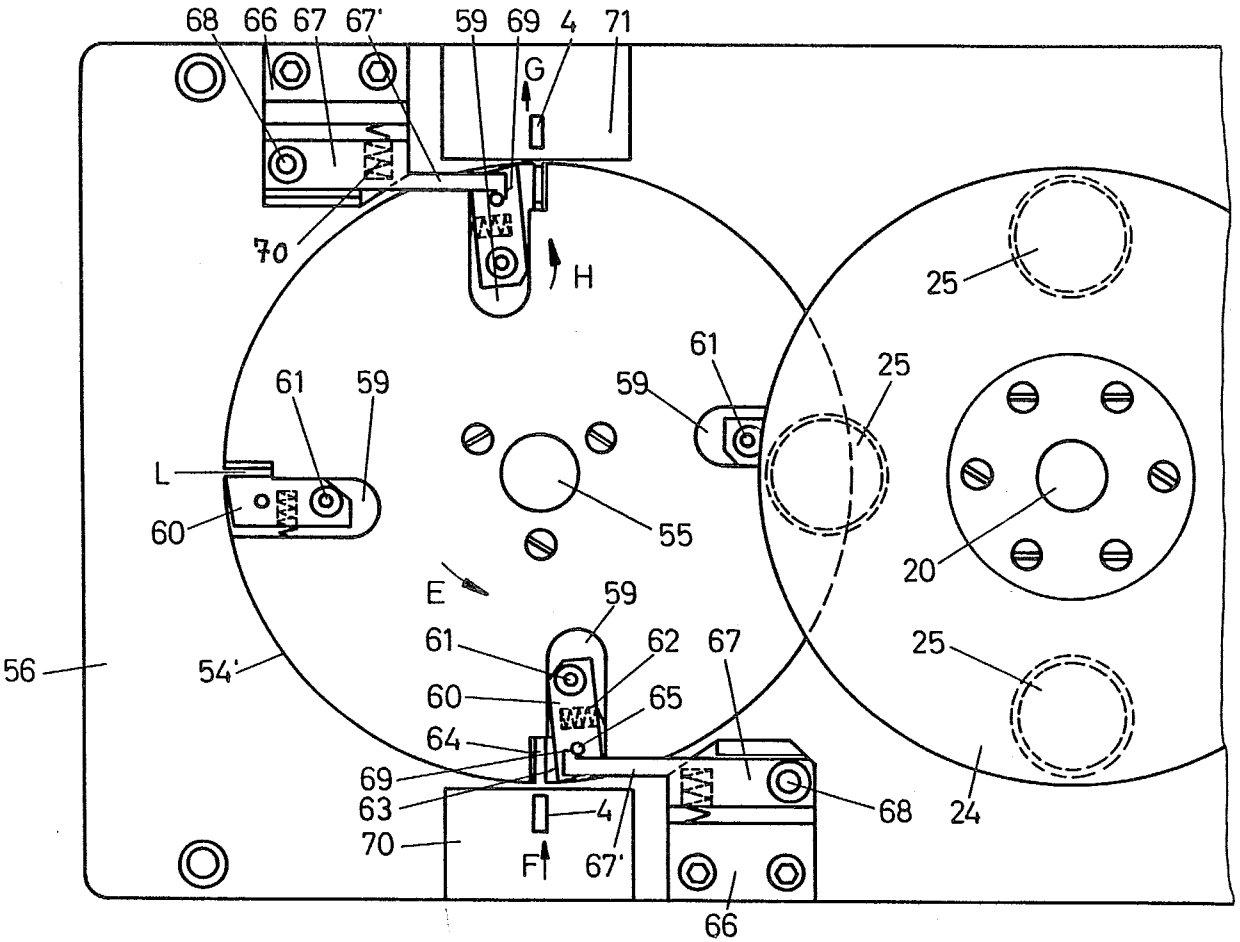
FIG. 6 is a plan view of a conveying plate of the printing mechanism according to FIG. 5 for supplying and removing the material to be printed to and from the printing position.

The printing mechanism according to FIGS. 5 and 6 differs from the printing mechanism accordng to FIGS. 1 to 4 merely by virtue of the fact that instead of the conveying device 53 a rotary table 54 essentially in the form of a circular disc is provided. The rotary table 52 is secured to a shaft 55 which is disposed parallel to and at a distance from the shaft 20 and which is rotataly mounted on the plate slabs 2 and on a stationary auxiliary plate slab 56, which is provided below the rotary table 54 and which is connected to the lower plate slab 2 for example by way of spacing elements, in such a way that a partial area of the element 24 and a partial area of the rotary table 54 in the form of a circular disc cover one another in each case. At the upper end the shaft 55 supports a gearwheel 57 which is connected by way of an intermediate gearwheel 58 mounted on the upper plate slab 2 to the gearwheel 19, so that the rotary table 54 is driven in a rotating and clock-timed manner synchronously with the drive of the printing mechanism.

On its top side facing the elements 25 the rotary table 54 is provided with groove-like openings 59 which extend radially to the axis of the shaft 55 and which are open to the top side and towards the edge 54' of the rotary table. The number of the openings 59 arranged distributed at uniform angular distances about the axis of the shaft 55 is equal to the number of the elements 25. A clamping jaw 60 constructed in the form of a lever is rotatably mounted at one end in each opening 59 with the aid of a pivot pin 61 lying parallel to the axis of the shaft 55, the pivot pin 61 lying closer to the shaft 55 than the free end of the clamping jaw 60 extending as far as the peripheral surface 54'. Each clamping jaw 60 is pretensioned by a compression spring 62 in such a way that when the spring 62 is released the clamping jaw 60 has one of its longitudinal sides extending radially to the shaft 55, namely the longitudinal side acting as a holding surface 63, lying directly adjacent an extension 64 which each opening 59 comprises in the vicinity of the peripheral surface 54'. Each clamping jaw 60 is provided at its free end with a pin 65 which projects upwards and which trails behind the associated extension 64 in the direction of rotation of the rotary table 54 (arrow E).

On the top side of the auxiliary plate slab 56 are provided two holding blocks 66 which are offset with respect to one another by 180° about the axis of the shaft 55 and on which a stop element 67 constructed in the form of a lever is mounted in each case so as to be pivotable at one end about a pivot pin 68 lying parallel to the axis of the shaft 55. The other end of each stop element 67 is formed with a reduced cross-section in the manner of a finger and comprises a nose-like projection 69 which points towards the shaft 55 and which on one side forms an oblique bearing surface for the pins 65. Each stop element 67 is prestressed by a compression spring 70 in such a way that the finger-like end 67' with the projection 69 lies in the area of movement of the pins 65. In addition, the two stop elements 67 are arranged in such a way that their projections 69 lie on a connecting line which extends approximately at right angles to the line L which intersects the axes of the shafts 16, 20 and 55.

When a pin 65 moves past the projection 69 of a stop element, the corresponding clamping jaw 60 is always pivoted in the direction of arrow H against the action of the spring 62, so that one component 4 can be moved into the extension 64 from the conveying device 70 on which the components 4 are delivered in the direction of arrow F, or one component 4 can be transferred from an extension 64 to the conveying device 71 by which the printed components are taken away in the direction of arrow G. As the rotary table 54 moves on, each pin 65 moves out of engagement again with the projection 69, so that the respective clamping jaws swing back to their rest or clamping position contrary to the arrow H and the component 4 transferred from the conveying device 70 to the rotary table 54 is clamped in the extension 64. It is to be understood that the rotational movement of the rotary table 54 always has a stoppage phase when an extension 64 is at the conveying device 70, an extension 64 is at the conveying device 71 and the extension 64 is below an element 25, so that the component 4 held in the latter extension can be printed on its face projecting beyond the top side of the rotary table 54 by the element 25 which is moving downwards. The conveying devices 70 and 71 are conventional conveying devices, for example linear conveyors (e.g. vibration conveyors) in which the components 4 are guided in a guide rail. Additional aids (not shown), such as air-discharge nozzles or mechanical elements for moving the components 4 are preferably provided in order to bring the components 4 from the conveying device 70 into the extension 64 available in each case or in order to transfer the components 4 from the extension 64 to the conveying device 71, respectively.

Figure 7:
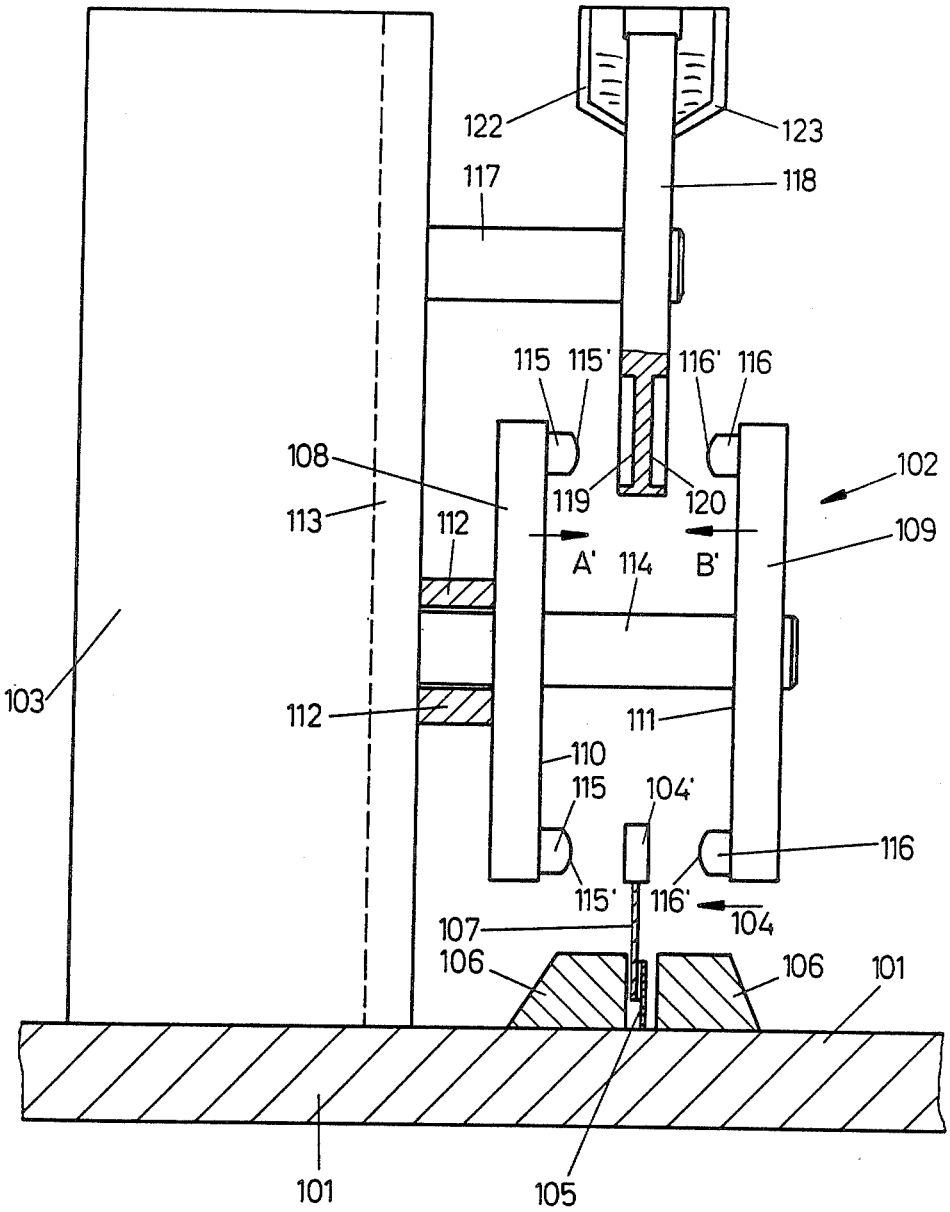
FIG. 7 is a side elevation, viewed diagrammatically, of a further embodiment of the printing mechanism.
Figure 8:
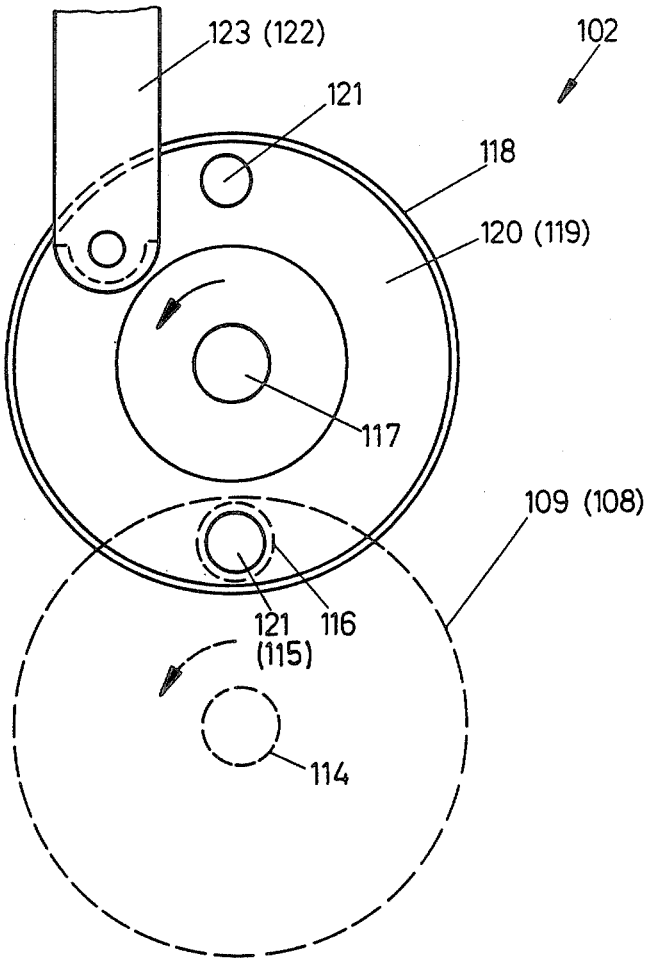
FIG. 8 is a simplified plan view of an end face of the disc-shaped element—comprising the printing plates—of the printing mechanism according to FIG. 7.

In the embodiment according to FIGS. 7 and 8, the numeral 101 designates the work bench—lying with its top side in a horizontal plane—of a machine frame or machine support not otherwise shown in greater detail. The printing mechanism 102, the driving elements of which are arranged in a casing 103, is secured to the top side of the work bench 101 at a point where the material to be printed is to be given an impression, for example at the end of a production line. The material to be printed is formed by electrical components 104, which are held taped in a quasi-radial manner on a belt band 105 which lies with its longitudinal extension at right angles to the plane of the drawing of FIG. 7. By means of suitable guiding and driving means which are provided on the top side of the work bench 101 and which are shown merely as guide rails 106 for the sake of simplicity of illustration, the belt band 105 is guided edgewise, i.e. with its surface sides lying in vertical planes and thus at right angles to the top side of the work bench 101, in such a way that the bodies 104' of the components 104 are arranged above the upper edge of the belt band 105 or the leads 107 project upwards in the vertical direction beyond the upper edge of the belt band 105 and at their upper end they support the component bodies 104'. The belt band 105 and therefore also the components 104 held thereon are moved in a clock-timed manner in a horizontal direction or in a direction at right angles to the plane of the drawing of FIG. 7.

Two elements 108 and 109 formed like circular discs are provided outside the casing 103 in such a way that the two mutually facing end faces 110 and 111 respectively of these elements are disposed at a distance from one another but parallel to one another, the axes of the elements 108 and 109 passing through the respective centre are arranged coaxially with one another and extend in a horizontal direction, i.e. in a direction parallel to the top side of the work bench 101, and in a direction at right angles to the direction of movement of the belt band 105.

The element 108 is secured non-rotatably at one end—projecting from the casing 103—of a hollow shaft 112 which is mounted in the interior of the casing 103 or on a plate slab 113 so as to be rotatable and displaceable in the axial direction, which [plate slab] closes off the interior of the casing on the side facing the elements 108 and 109. The element 109, which is further from the plate slab 113 than is the element 108, is held non-rotatably at the end of a shaft 114, which likewise projects outwards with this end beyond the casing 103 and is mounted in the casing 103 or in the hollow shaft 112 respectively so as to be rotatable and axially displaceable. The axes of the hollow shaft 112 and the shaft 114 are coaxial with one another and coaxial with the axes of the elements 108 and 109 and thus likewise extend in the horizontal direction. By means of driving means (not shown in greater detail) the hollow shaft 112 and the shaft 114 and therefore also the elements 108 and 109 mounted on these shafts are driven in a rotating and clock-timed manner, namely in such a way that after each rotation step, i.e. during each stoppage phase following a rotation step, the hollow shaft 112 and therefore also the element 108 are moved out of a rest position closer to the plate slab 113 into an operating position at a greater distance from the said plate slab in accordance with arrow A' and are then moved back, this stroke taking place in the direction of the axis of the hollow shaft 112. At the same time in each stoppage phase the element 109 is first moved out of a rest position at a greater distance from the plate slab 113 into an operating position closer to the said plate slab in accordance with arrow B' and is then moved back again into the rest position contrary to arrow B'. This stroke of the element 109, corresponding in magnitude to the stroke of the element 108, is also performed in the direction of the axis of the hollow shaft 112 and the shaft 114 respectively. In order to attain the clock-timed rotational movement of the elements 108 and 109 having the same diameter and rotating synchronously and in the same direction of rotation, there is provided in the interior of the casing a step-by-step motion linkage which is driven by a drive motor which is not shown in greater detail and which conveys the beld band 105 either by way of the same step-by-step motion linkage or on the other hand by way of a further step-by-step motion linkage, so that the step-wise further movement of the belt band 105 and thus the components 104 also takes place synchronously with the rotational movement of the elements 108 and 109. In addition, in order to achieve the strokes (arrows A' and B') of the elements 108 and 109, a transmission arrangement likewise not shown and comprising at least one control cam is provided inside the casing 103, this transmission arrangement also being designed in such a way that the reciprocating movements of the elements 108 and 109 take place synchronously or simultaneously in opposite directions.

In the region of the peripheral surface of the elements 108 and 109, are provided printing elements 115 and 116 respectively, which are made essentially cylindrical and which are disposed in each case at the same radial distance from the axis of the shaft 114 or the hollow shaft 112 respectively and consist of resilient material, for example rubber or elastic plastics material, distributed in each case at uniform angular distances about the axes of the said elements 108 and 109, on the mutually facing end faces 110 and 111. The elements 115 and 116, which lie with their cylindrical axis parallel to the axis of the shaft 114 or the hollow shaft 112 respectively, are secured at one end or at one end face respectively to the end face 110 or 111 respectively of the associated element 108 or 109 respectively. At the other end or at the other end face respectively the printing elements are made convex and they form at that point the print transfer surfaces 115' and 116' respectively, all the print transfer surfaces 115' being at the same distance from the end face 110 and all the print transfer surfaces 116' being at the same distance from the end face 111. In addition, in the embodiment illustrated, the printing elements 115 and 116 are arranged in such a way that in the direction of the axis of the shaft 114 or the hollow shaft 112 respectively one printing element 116 on the element 109 is directly opposite each printing element 115 on the element 108, which also means that the number of the printing elements 115 is equal to the number of the printing elements 116.

A shaft 117 is rotatably mounted above the shaft 114 or the hollow shaft 112 respectively in the casing 103 and in the plate slab 113 respectively, and with its axis lies parallel to the axis of the shaft 114. At its end projecting from the casing 103 the shaft 117 supports an element 118 in the form of a circular disc, which is provided at both its vertical end faces extending at right angles to the axis of the shaft 117 with an annular recess which is open to the respective end face and the respective base area 119 and 120 of which lies parallel to the end faces 110 and 111 of the elements 108 and 109 and is provided in the region of the periphery with printing plates 121 which are formed in each case by linear or puncitform recesses on the said base areas. The printing plates 121 on each base area 119 and 120 respectively are arranged distributed by equal angular distances in each case about the axis of the shaft 117 and are also at the same radial distance in each case from the said axis, one printing plate 121 on the base area 120 being directly opposite each printing plate 121 on the base area 119 in the direction of the axis of the shaft 117. All the printing plates 121 on each base area 119 and 120 respectively are made similar, it being possible for the printing plates 121 on the base area 119 to be different from the printing plates 121 on the base area 120, i.e. the printing plates 121 on the base area 119 are used for example for printing technical data on one side of the parallelepipedal component body 104' and the printing plates 121 on the base area 120 are used for printing manufacturers' information on the other opposite side of the component body 104'. In principle it is also possible, of course, to make the printing plates 121 on the base area 119 identical with the printing plates 121 on the base area 120, so that the printed component bodies 104' are completely legible from both sides. The thickness of the element 118 in the region of the printing plates 121, i.e. the distance between the base areas 119 and 120, is approximately equal to the thickness of the component body 104' in the direction of the axis of the shaft 114, i.e. approximately equal to the distance between the two surfaces of the component body 104' to be printed.

In principle, it is also possible, at least on one side of the element 118, for the printing surfaces 121 to be provided not directly on the base area 119 and 120 respectively, but on one surface side of the disc 34 described above.

The shaft 117, which is mounted so as to be rotatable, but not axially displaceable, is likewise driven in a rotating and clock-timed manner, namely synchronously with the drive of the elements 108 and 109, the drive of the element 118 preferably being in the same direction as the drive of the elements 108 and 109, i.e. all the elements have the same direction of rotation. The element 118 has the same diameter as the elements 108 and 109. In addition, the shaft 117 is mounted in the casing 103 in such a way and the element 118 is secured to the said shaft in such a way that it extends with a partial area into the space between the elements 108 and 109, namely in such a way that in each stoppage phase of the elements 108, 109 and 118 a printing plate 121 on the base area 119 is directly opposite a printing element 115 and a printing plate 121 on the base area 120 is directly opposite a printing element 116 in the direction of the axes of the shaft 117. This also means that the distance between the axes of the shafts 114 or 112 respectively and the axes of the shaft 117 is equal to the sum of the radial distance of the printing plates 121 from the axis of the shaft 117 and the radial distance of the printing elements 115 or 116 respectively from the axis of the shaft 114.

In addition, two devices 122 and 123 for inking the printing plates 121 with printing ink are provided on the element 118. By means of these devices which are constructed in the form of doctor blades and which are used for supplying the printing ink, it is made possible for the printing plates 121 which pass the devices 122 and 123 during the rotation of the element 118 to be provided with printing ink only in the region of the linear or punctiform recesses which form the said printing plates.

The angular distance between the printing elements 115 and 116 on the elements 108 and 109 corresponds to one rotational step of the said elements in each case. In the same way the distance between the printing plates 121 on each base area 119 and 120 respectively corresponds to one rotational step of the element 118. The number of the printing plates 121 on the base areas 119 and 120, [and] the number of the printing elements 115 and 116 on the elements 108 and 109 are adapted to the magnitude of the rotational steps of these elements in such a way that in each stoppage phase of these elements not only is a printing plate 121 opposite one printing element 115 and 116 in each case, but the body 104' of a component is positioned between two other printing elements 115 and 116.

Figure 9:
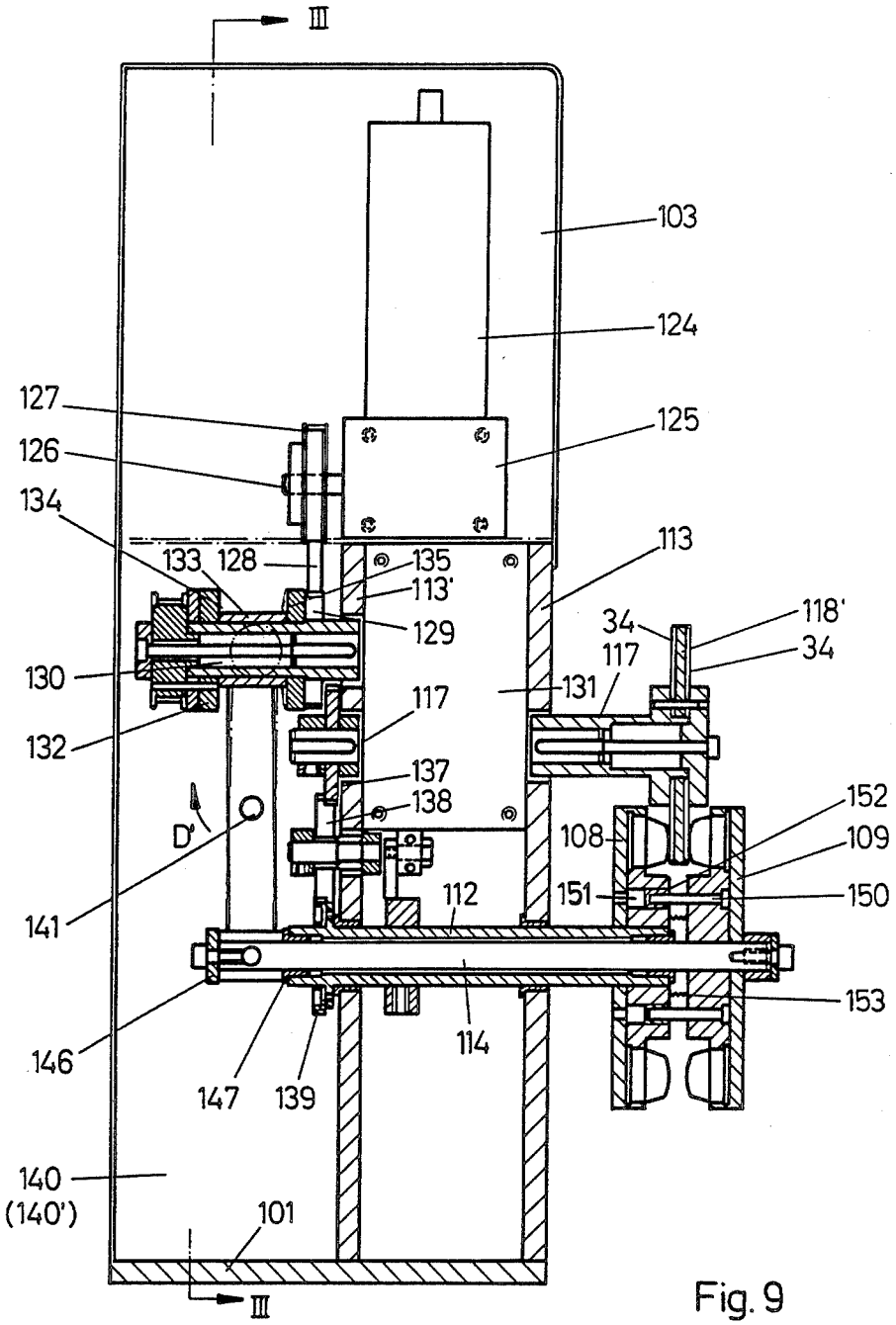
FIG. 9 is a longitudinal section of a modified embodiment of the printing mechanism according to FIG. 7.
Figure 10:
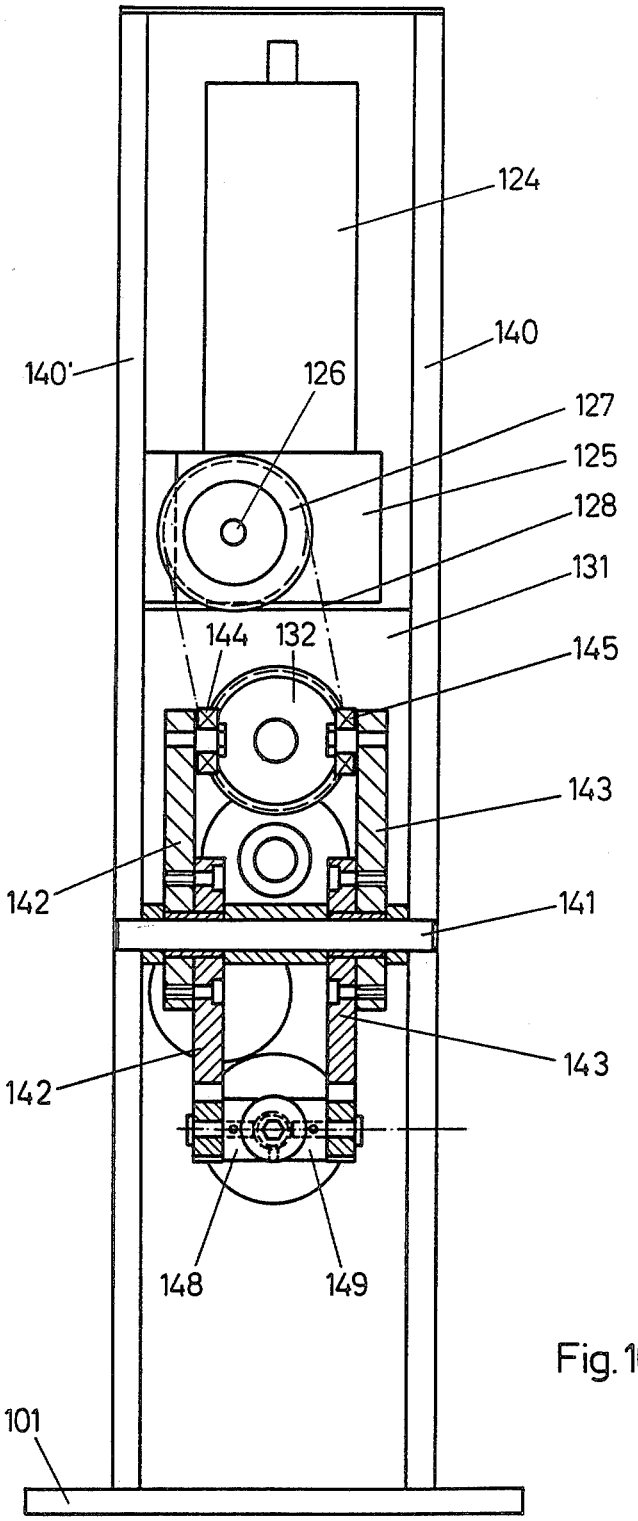
FIG. 10 is a section corresponding to the line III—III of FIG. 9.
Figure 11:
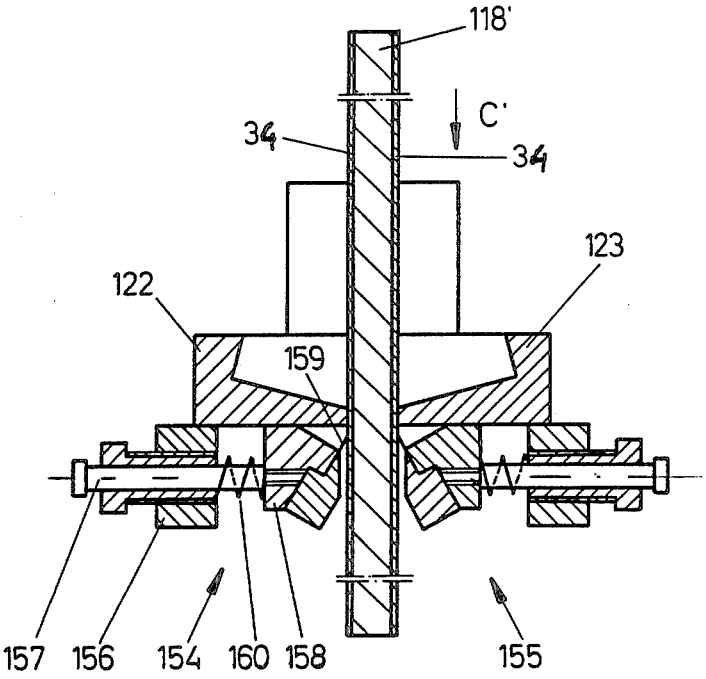
FIG. 11 is an enlarged, detailed view of the device for applying printing ink to the printing plates, together with the disc-shaped element comprising the printing plates in the case of the printing mechanism according to FIG. 9.

FIGS. 9 to 11 show in detail a printing mechanism, which is constructed in essentially the same way as the printing mechanism according to FIGS. 7 and 8, but differs from the printing mechanism in FIGS. 7 and 8 only on account of the fact that instead of the element 118 use is made of an element 118' with level end faces, on which is provided a disc 34 comprising the printing plates 35, each disc 34 being constructed and secured in the manner described in the case of the embodiment according to FIGS. 1 to 4.

Inside the casing 103 a further plate slab 113' is provided parallel to and at a distance from the plate slab 113. At the upper edge of both plate slabs the drive motor 124 (electric motor) is provided with a transmission 125 for driving the printing mechanism. On the output shaft 126 of the transmission is mounted a belt pulley 127 which is connected by way of a toothed belt 128 to a belt pulley 129, which is mounted on the input shaft 130 of a step-by-step motion linkage 131. On the shaft 130 is further provided a control disc 132 with a continuous annular groove 133 which at its mutually facing lateral surfaces forms two control cams 134 and 135 respectively, which are each constructed simialrly to the control cam formed by the edge 15 and in a partial area extending about the axis of the shaft 130 in each case are at a greater distance from the plate slab 113' and in another partial area are closer to the plate slab 113'. A gearwheel 137, which is connected by way of an intermediate gearwheel 138 rotatably mounted on the plate slab 113' to a gearwheel 139 which is secured to the hollow shaft 112, is mounted on the end—projecting to the left beyond the plate slab 113'—of the shaft 117 which forms the output shaft of the step-by-step motion linkage 131 disposed between the two plate slabs 113 and 113'. The end of the shaft 117 projecting to the right beyond the plate slab 113 supports the element 118'.

In the interior of the casing 103 two further plate slabs 140 and 140' are provided parallel and at a distance from one another, which lie with their surface sides at right angles to the surface sides of the plate slabs 113 and 113' and are joined to the said plate slabs. A pivot pin 141, which lies with its axis at right angles in an axial direction to the axis of the hollow shaft 112 and the shaft 114 respectively, is mounted at both ends between the plate slabs 140 and 140'. Two double-armed levers 142 and 143 are mounted on the pivot pin 141 so as to be pivotable approximately at their middle in each case. At their upper ends the two levers support rollers 144 and 145 respectively, which are rotatable in each case about an axis parallel to the axis of the pivot pin 141. The roller 144 of the lever 142 bears against the control cam 134 and the roller 145 of the lever 143 bears against the control cam 135. In the interior of the casing 103, a disc 146, which has a greater external diameter than the shaft 114, is provided on the end of the shaft 114 remote from the elements 108 and 109. A sleeve 147 forming a sliding bearing is mounted on the end of the hollow shaft 112 remote from the elements 108 and 109 in the interior of the casing 103. The lower end of the lever 142 bears with a sliding member 148 secured to the said end against the end face of the disc 146 facing the elements 108 and 109. A sliding member 149 secured to the lower end of the lever 143 bears with its side facing the elements 108 and 109 against the sleeve 147.

Between the elements 108 and 109 are provided a plurality of guide elements which, although permitting movement of the elements 108 and 109 in the direction of the arrows A' or B' respectively or in the opposite direction, prevent the elements 108 and 109 from being able to rotate relative to one another about the axis of the shaft 114. These guide elements comprise in each case a bolt 150 which is held by a thread in a threaded bore in the element 109, lies with its axis parallel to the axis of the shaft 114 and extends with one end into a bore 151 of the element 108. A sliding sleeve 152, which slides with its outer surface on the wall of the bore 151, is secured rotationally rigidly to this end of the bolt 150. The elements 108 and 109 are also connected together by way of the bolt 150 in such a way that as the hollow shaft 112 rotates the element 109 mounted on the shaft 114 is jointly rotated by the element 108 secured to the said hollow shaft. A plurality of compression springs 153, which force the elements 108 and 109 out into their respective positions of rest, are provided between the end faces of the elements 108 and 109 facing one another. The ratio of the step-by-step motion linkage 131 and the control cams 134 and 135 are arranged such that after each rotational step of the shaft 117 and of the shafts 112 and 114 during the stoppage phase following this rotational step the levers 142 and 143 are swung by the control cams 134 and 135 respectively about the pivot pin 141 from a rest position into an operative position, i.e. the lever 142 in the direction of the arrow D' and the lever 143 contrary to this direction, and they are then pivoted back into the rest position, so that the elements 108 and 109 in each stoppage phase execute an operating stoke from the rest position in the direction A' and B' respectively and back to the rest position. The step-by-step motion linkage 133 is preferably designed in such a way that during a complete revolution of the shaft 130 the shaft 117 performs four rotational steps with a following stoppage phase in each case.

FIG. 11 shows in detail the device for inking the printing plates 35*a* to 35*c* on the discs 34. This device again comprises the two elements 122 and 123. Wiping apparatus 154 and 155 are provided in each case following the elements 122 and 123 in the direction of rotation of the element 118' and each comprises a stationary holding block 156, which is secured to the element 122 and 123 respectively, and a block 158, which is held on the said block 156 with the aid of guide pins 157 so as to be displaceable in a direction at right angles to the end faces of the element 118' and which supports a knife-like wiper 159 which bears resiliently against the surface side of the respective disc 34 provided with the printing plates 35*a* to 35*c*, namely on account of the compression spring 160 acting between the blocks 156 and 158. In FIG. 11, the two wipers formed in each case by the cutter blades are arranged in such a way relative to the direction of rotation of the element 118' that these wipers together with the respective surface of the ring 34 form an acute angle which opens in the direction of rotation of the element 118' (arrows C'). It is also possible, however, for the wipers 159 and likewise also the wiper 50 according to FIGS. 1 to 4 to be arranged in such a way that the said wiper together with the surface side of the disc 34 forms an acute angle which opens away from the direction of rotation of the element 118' or the element 32 respectively.

The mode of operation of the printing apparatus according to FIGS. 7 to 10 may be described as follows:

In each stoppage phase of the elements 108, 109 and 118, two printed images are transferred from the inked-in printing surfaces 121 simultaneously to the print transfer surfaces 115' and 116' respectively. The print transfer surfaces 115' and 116' respectively provided with these printed images then pass after one or more rotation steps of the elements 108 and 109 to the region at which a component body 104' is present between the said elements, so that the printed images can then (in a stoppage phase) be printed on the surface sides of an available component body 104'.

Since very small, perfectly legible impressions are to be achieved with the printing mechanisms described and an absolutely precise rotational movement of the elements is necessary for this, it may be advantageous to provide a braking apparatus for a shaft as indicated in FIG. 5 by the braking apparatus 72 for the shaft 20. By means of this braking apparatus, inaccuracies are eliminated which could arise from the play of the driving gearwheels 17 to 19, since a constant braking torque is continuously exerted upon the shaft 20.

I claim:

1. A printing mechanism for producing an impression on a surface of material to be printed lying in a printing plane, comprising a first element which is mounted on a machine frame so as to be rotatable about a first axis of rotation and is driven in a clock-timed manner and which comprises at least one print transfer surface on at least one surface area, a second element which is mounted on the machine frame so as to be rotatable about a second axis of rotation extending parallel to the first and is likewise driven in a clocked-timed manner and which comprises at least one printing plate on at least one surface area facing the first element, and a device for applying printing ink onto the printing plate, it being possible for at least one of the two elements to be reciprocated between two positions relative to the other in such a way that the print transfer surface bears in a first, operative, position against the printing plate and in a second, rest, position is at a distance from the printing plate, characterized in that the printing plate and the print transfer surface are disposed in planes extending at right angles to the axes of rotation and the elements are movable relative to one another in the direction of the axes of rotation, wherein the second element comprises on its surface side facing the first element a circular or annular recess which is open towards the first element and closed towards the periphery and on the base area of which are provided the printing plates, a wiper for applying the printing ink extending into the recess and resting with its wiping edge against the base area of the recess, wherein the wiper is formed by a curved wall, and a removal device, which extends into the recess and which comprises a cutting edge resting on the base area of the recess, and following the wiper in the direction of rotation of the second element.

2. A printing mechanism according to claim 1, wherein at least two groups of different printing plates are provided on the second element, the printing plates of each group being offset relative to one another by a first equal angular distance in each case about the second axis of rotation and the printing plates of each group being offset relative to the printing plates of another group by a second angular distance, whereby the second element can be fastened at different positions corresponding to the second angular distance on a shaft forming the second axis of rotation.

3. A printing mechanism according to claim 1, wherein the print transfer surfaces are formed by the free ends of projections preferably of resilient material, which projections extend beyond the surfaces of the first element facing the second element.

4. A printing mechanism according to claim 1, wherein said cutting edge extends obliquely to the direction of rotation of the second element and is at a distance from the inner and outer boundary surfaces of the recess.

5. A printing mechanism according to claim 1, wherein the first element is secured to at least one shaft which is mounted rotatably and axially displaceably in the machine frame and can be reciprocated in the axial direction by a control cam which is provided on a continuously rotating shaft.

6. A printing mechanism according to claim 1, wherein said first element and said second element are secured to shafts which are connected together in a driving manner and one of which is the output shaft of a step-by-step motion linkage.

7. A printing mechanism according to claim 6, further comprising a control cam on the input shaft of the step-by-step motion linkage.

8. A printing mechanism for producing an impression on a surface of material to be printed lying in a printing plane, comprising a first element which is mounted on a machine frame so as to be rotatable about a first axis of rotation and is driven in a clock-timed manner and which comprises at least one print transfer surface on at least one surface area, a second element which is mounted on the machine frame so as to be rotatable about a second axis of rotation extending parallel to the first and is likewise driven in a clock-timed manner and which comprises at least one printing plate on at least one surface area facing the first element, and a device for applying printing ink onto the printing plate, it being possible for at least one of the two elements to be reciprocated between two positions relative to the other in such a way that the print transfer surface bears in a first, operative, position against the printing plate and in a second, rest, position is at a distance from the printing plate, characterized in that the printing plate and the print transfer surface are disposed in planes extending at right angles to the axes of rotation and the elements are movable relative to one another in the direction of the axes of rotation, wherein the first element comprises two individual elements arranged offset with respect to one another in the direction of the first axis of rotation at least one print transfer surface is provided on the mutually facing sides of the two individual elements of the first element in each case, the mutually facing print transfer surfaces can be moved in opposite directions in the direction of the first axis of rotation from the rest position, in which the mutually facing print transfer surfaces are at a greater distance from one another, into the operative position, in which the mutually facing print transfer surfaces are closer to one another, the second element comprises at lest one printing plate in each case on two surface areas facing away from one another, the path of movement of the two surface areas comprising at least one printing plate in each case of the second element extends in a partial portion between the paths of movement of the print transfer surfaces, and two printing planes are formed between the paths of movement of the print transfer surfaces.

9. A printing mechanism according to claim 8, wherein the first individual element of the first element is secured to a hollow shaft and the second individual element of the first element is secured to a shaft which extends with at least part of its length into the hollow shaft, and the hollow shaft is mounted rotatably and axially displaceably on the machine frame and the shaft of the second individual element is mounted rotatably and axially displaceably in the said hollow shaft and/or on the machine frame.

10. A printing mechanism according to claim 9, wherein the second element is secured to a shaft which is mounted rotatably but not axially displaceably in the machine frame.

11. A printing mechanism according to claim 10, wherein the second element is constructed in the form of a circular disc and comprises at least one printing plate on each of the two end faces extending at right angles to the second axis of rotation.

12. A printing mechanism according to claim 11, wherein at least one individual element of the first element is constructed in the form of a circular disc and comprises at least one print transfer surface on its end face facing the other individual element and extending at right angles to the first axis of rotation.

13. A printing mechanism according to claim 8, wherein in the direction of the first axis of rotation the print transfer surface on one individual element is directly opposite the print transfer surface on the other individual element of the first element, and the printing plates on the two surface areas of the second element are provided congruently in the direction of the second axis of rotation on the second element.

14. A printing mechanism according to claim 13, wherein the number of the print transfer surfaces on one individual element is equal to the number of the print transfer surfaces on the other individual element.

15. A printing mechanism according to claim 13, wherein the number of printing plates on one surface area of the second element is equal to the number of the printing plates on the other surface area of the second element.

16. A printing mechanism according to claim 8, wherein the device for applying printing ink is formed by two individual devices, each of which is provided in a stationary manner on a surface area of the second element.

17. A printing mechanism according to claim 8, wherein the second element comprises on its surface side facing the first element a circular or annular recess which is open towards the first element and closed towards the periphery and on the base area on which is provided the printing plate, and further comprising a wiper for applying the printing ink extending into the recess and resting with its wiping edge against the base area of the recess, wherein the wiper is formed by a curved wall, and a removal device, which extends into the recess and which comprises a cutting edge resting on the base area of the recess, and following the wiper in the direction of rotation of the second element.

* * * * *